US005961435A

United States Patent [19]

Schafer

[11] Patent Number: 5,961,435

[45] Date of Patent: Oct. 5, 1999

[54] FOLDING DEVICE

[76] Inventor: Hermann Schafer, H.-Löns-Strasse 37, D-35116 Hatzfeld, Germany

[21] Appl. No.: 08/508,651

[22] Filed: Jul. 28, 1995

[30] Foreign Application Priority Data

Jul. 28, 1994 [DE] Germany ..... 94 12 210 U

[51] Int. Cl.[6] ..... B31D 3/02

[52] U.S. Cl. ..... 493/437

[58] Field of Search ..... 493/411, 412, 493/413, 414, 415, 468, 476, 359, 356, 357, 360, 410, 433, 448

[56] References Cited

U.S. PATENT DOCUMENTS

| | | | |
|---|---|---|---|
| 2,241,329 | 5/1941 | Shaffer | 493/413 X |
| 4,188,024 | 2/1980 | Seragnoli | 493/448 X |
| 4,425,111 | 1/1984 | Chazelas | 493/448 X |
| 4,673,382 | 6/1987 | Buck et al. | 493/412 X |
| 4,976,677 | 12/1990 | Siversson | 493/413 |
| 5,149,075 | 9/1992 | Crowley et al. | 493/412 X |
| 5,160,563 | 11/1992 | Kutchmarek et al. | 156/204 |

*Primary Examiner*—David A. Scherbel
*Assistant Examiner*—Anthony Ojini
*Attorney, Agent, or Firm*—Lowe Hauptman Gopstein Gilman & Berner

[57] ABSTRACT

A folding device (10) includes: two cam-controlled folding knives (20, 21) that are vertically moveable relative to each other; a run-in table (60) vertically shiftable synchronously with the folding knives; and a counter-pressure line (80) having at least one pressure cylinder (82) per sliding block (84). The shafts (30, 31) and their drive systems (50, 51) are shiftable in mutually opposed vertical directions and are synchronized, e.g. electronically or via T-type gears (53, 54) having a common motor (52). At least one shaft (31) with its motor (51) is shiftable in a linear carriage (37) of a vertical linear slideway (38). The folding knives (20, 21) are rotatably supported at linear carriages (24, 25) guided on linear slideways (27, 28) and connected to cam disks (40, 41) which, synchronously with at least two eccentric disks (44) fixed to the shafts (30,31), bear on associated rocker levers (45). A measuring system (86) behind the sliding blocks (84) is adapted for travelling across the entire working width (A). A control display unit (90) continuously shows the height shifting of the folding knives (20, 21), of the run-in table (60) and of an upper shaping plate or upper table (65).

33 Claims, 9 Drawing Sheets

FOLDING DEVICE

BACKGROUND OF THE INVENTION

The invention relates to a folding device as set forth in the claims.

Conventional folding machines comprise folding knives guided in link brackets or gates for relative vertical motion via cam disks, slide means serving to press the knives towards each other. In order to change the folding height, it is necessary to loosen fixing and set screws for manually adjusting the folding knives on a support bar or beam and then to secure the screws or bolts again. All of this requires plenty of time and may lead to inaccuracies such as lacking parallelism of the folds. Since the machine must be shut off for this work, it is impossible to vary the folding height during operation.

SUMMARY OF THE INVENTION

It is an important object of the invention to create a folding device suited for adapting the folding height in operation. The invention further aims at simplifying the handling of the machine as compared to conventional folding devices.

The main features of the invention are recited in the independent claims as well as in other claims. Various details of the invention are recited in the dependent claims.

In a folding device including two motor-driven folding knives which are vertically movable relative to each other by means of cam disks supported on shafts to which drive systems are associated, including a run-in table for material to be folded and including a counter-pressure line, the invention provides that the shafts are synchronized and that they and/or their drive systems are coupled for shifting in mutually opposing vertical directions. Fold adjustments can, therefore, be made quickly and easily without the need for special tools or contrivances. If required, the folding height can be readjusted at any time during the folding operation, too, so that the device need not be shut down for the purpose. As the coupled shafts are synchronized, it is warranted that the folds produced are exactly parallel irrespective of their height.

According to claim 2, the drive systems comprise electronically coupled motors whereby full synchronism of the shafts and thus of the folding knives is achieved, resulting in accurate folding height and great reliability of operation.

In the embodiment of claim 3, the drive systems for the shafts comprise T-type gears having a common motor. This leads to an extremely space-saving structure of the folding device. Moreover, the electrical and connection expenditures necessary are much reduced due to the use of a common motor; consequently, manufacture of the folding device is very economical.

By claims 4 to 7, the gears of the shafts are linked; a toothed shaft or a keyway according to claim 4 is a simple and inexpensive mechanical means, whereas an offset balance coupling system (so-called Schmitz-type coupling) according to claim 5, combines high operational reliability with low maintenance requirements. Linking via toothed belts or chains with gear units as provided in claim 6 is very sturdy and wear resisting. Another coupling variant as stated in claim 7 includes compact drive systems and cardan shafts with associated gears driven by at least one motor.

Independent protection is sought for the design of claim 8 according to which the drive systems and the shafts are shiftable in mutually opposing directions via a variable speed drive so that height adjustments for the folds can be effected during operation and, if desired, automatically. Handling of the folding device is greatly simplified and operating errors are effectively avoided. A lifting spindle unit by claim 9 is useful as a simple and economic component of the variable speed drive.

The further independent claim 10 comprises an advantageous design including a cam disk mechanism, e.g. an eccentric drive unit, for shifting the shafts and/or the drive systems in mutually opposing directions. By claim 11, at least one shaft and its drive are supported in a linear carriage of a vertical linear slideway. As the upper and/or the lower shaft is shifted, the folding height can be set rapidly and accurately. If the linear slideway includes a post jig or a slide track according to claim 12, the support is secure, exact, sturdy and highly reliable.

Preferably, in accordance with claim 13, at least two cam disks are associated to each of the folding knives whereby a very quiet run and a low noise level are achieved, resulting in a considerable improvement over conventional folding machines.

A favorable design according to claims 14 and 15 consists of a rotatable support of the folding knives by two vertical linear slideways each of which comprises linear carriages coupled to one cam disk each, with the slideways preferably including post jigs or slide tracks for guiding the folding knives in exactly parallel fashion so that a uniform fold height is achieved across the entire fold width.

The embodiment of independent claim 16 is of special advantage in that the shafts carry at least two, preferably three, eccentric disks which bear on rocker levers connected to the folding knives, synchronously with cam disks. Thus any bending of the shafts under the load of the folding knives is dependably prevented. Even strong materials such as cardboard, plastic sheets or sheet metal can, therefore, be safely folded in a convenient way.

A significant development of the invention is the subject matter of claim 17 wherein the run-in table and an upper shaping plate or upper table are vertically height-adjustable in synchronization with the folding knives, e.g. by means of an adjustable lifting spindle system or lever mechanism. The web to be folded is fed continuously at the center level of the folding knives so that uniformity of folding is greatly enhanced.

The distribution of forces and pressures is evened out if, according to claim 18, the counter-pressure line includes at least one pressure cylinder per sliding block or per contact pressure plate.

By claim 19, a measuring system may be arranged behind the sliding blocks for travelling across the total working width. As the actual fold height is continuously monitored and indicated, any deviations from desired values will be immediately recognized so that prompt correction is possible, i.e. in running manufacture. Display units as per claim 20 for continuously indicating the height positions of the folding knives, of the run-in table and of the upper shaping plate or upper table serve to increase the comfort and reliability of operation.

BRIEF DESCRIPTION OF THE DRAWINGS

Further features, details and advantages of the invention will become apparent from the following description of embodiments shown in the drawings wherein.

PREFERRED EMBODIMENT OF THE INVENTION

Figure 1:
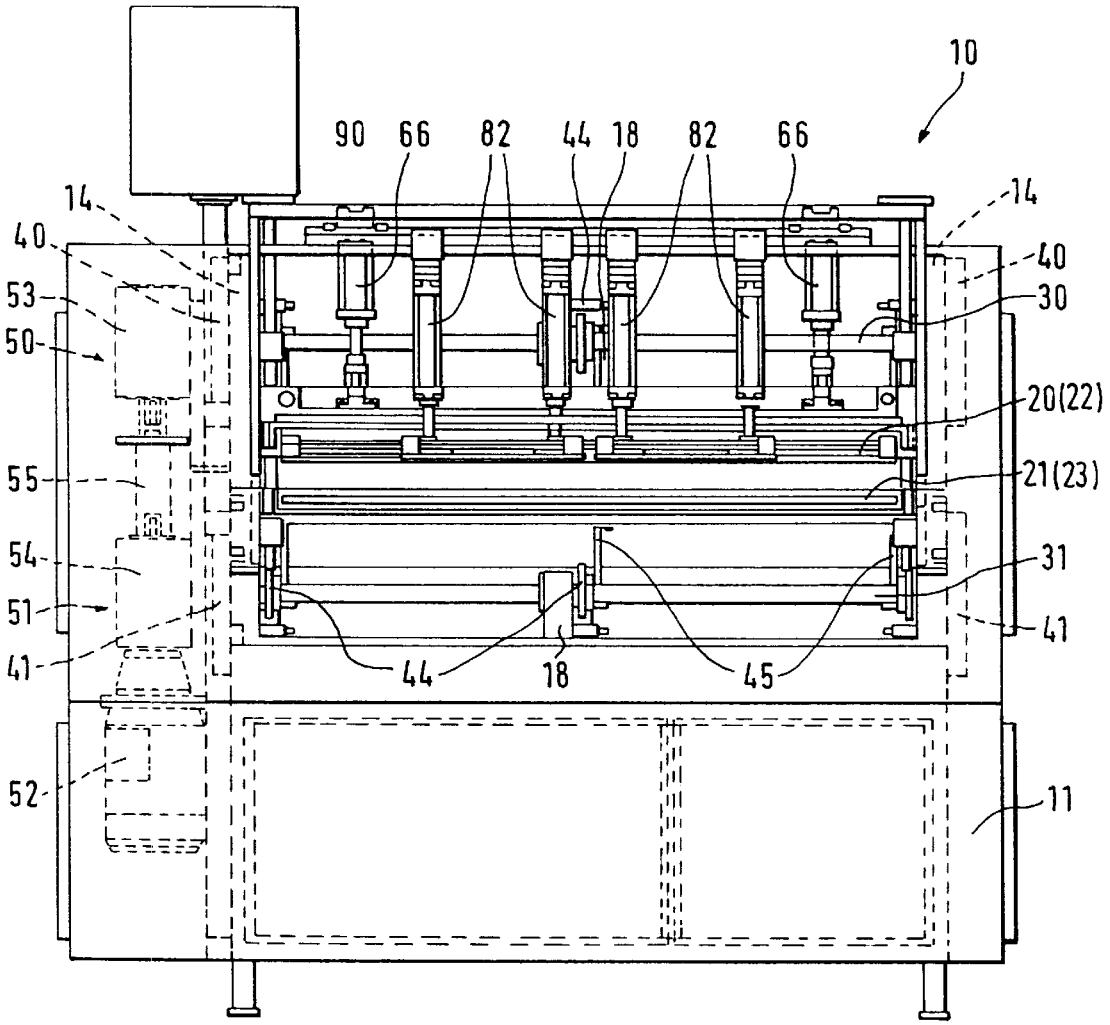
FIG. 1 is a schematic front view of a folding device.
Figure 2:
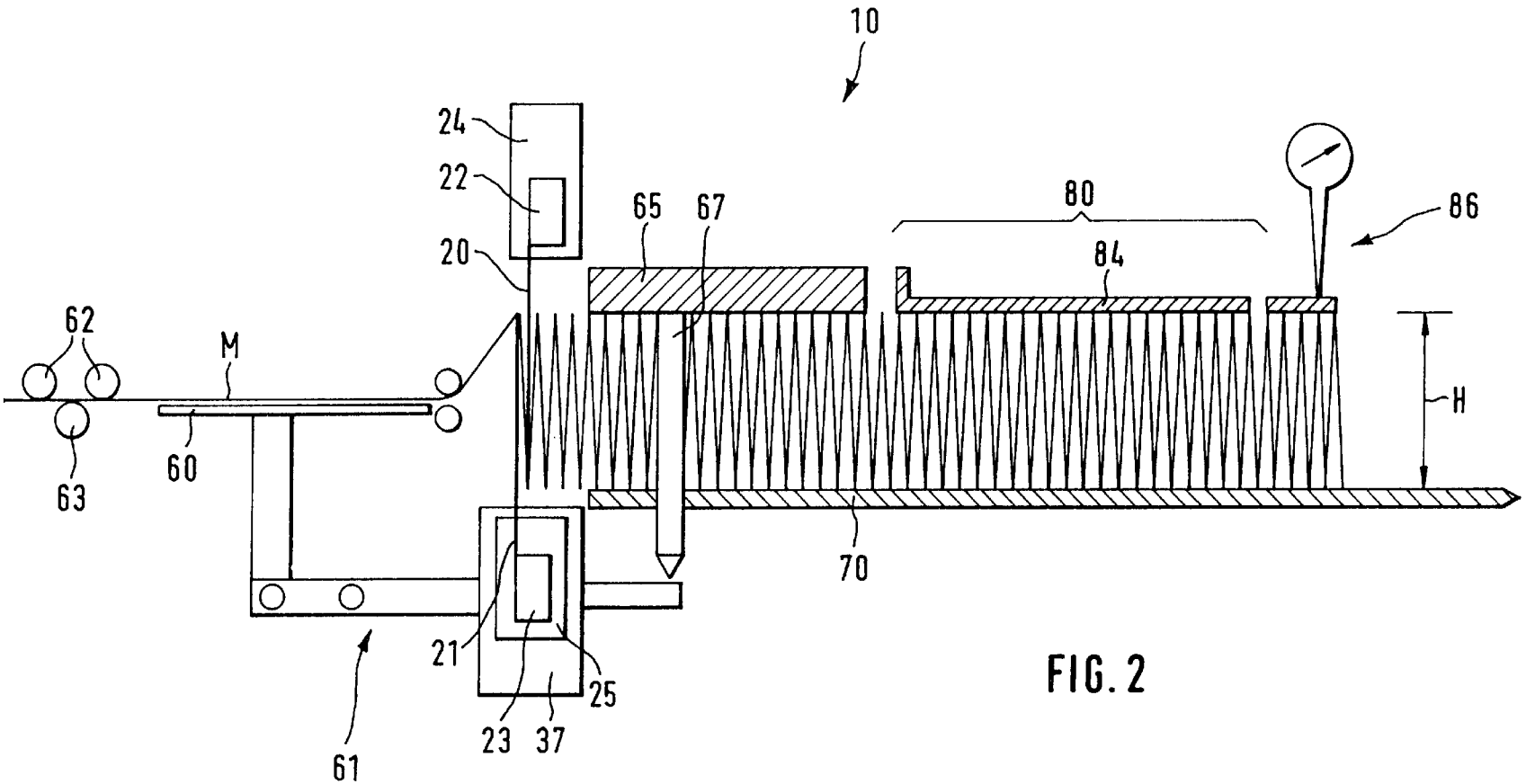
FIG. 2 is a skeleton side view of the folding device of FIG. 1.

A folding device 10 shown in FIGS. 1 and 2 comprises a frame 11 and therein two folding knives 20, 21 that are vertically movable via cam disks 40, 41; a run-in table 60 that is height-adjustable in relation to the folding knives 20, 21; counter-pressure line 80 for run-out of folded material M; and a control unit 90 which includes the important command indicators as well as operator elements, e.g. button switches, control knobs, displays, etc. for setting and controlling conditions such as speed and folding height. Unit 90 is movably arranged at frame 11, preferably so as to be pivotable by 180 degrees in order to allow reading the displays from any position at the folding device 10. Further setting and regulating means (not shown) for electric and pneumatic control are, in addition, integrated within the casing of the device 10 but also easily accessible.

Figure 3:
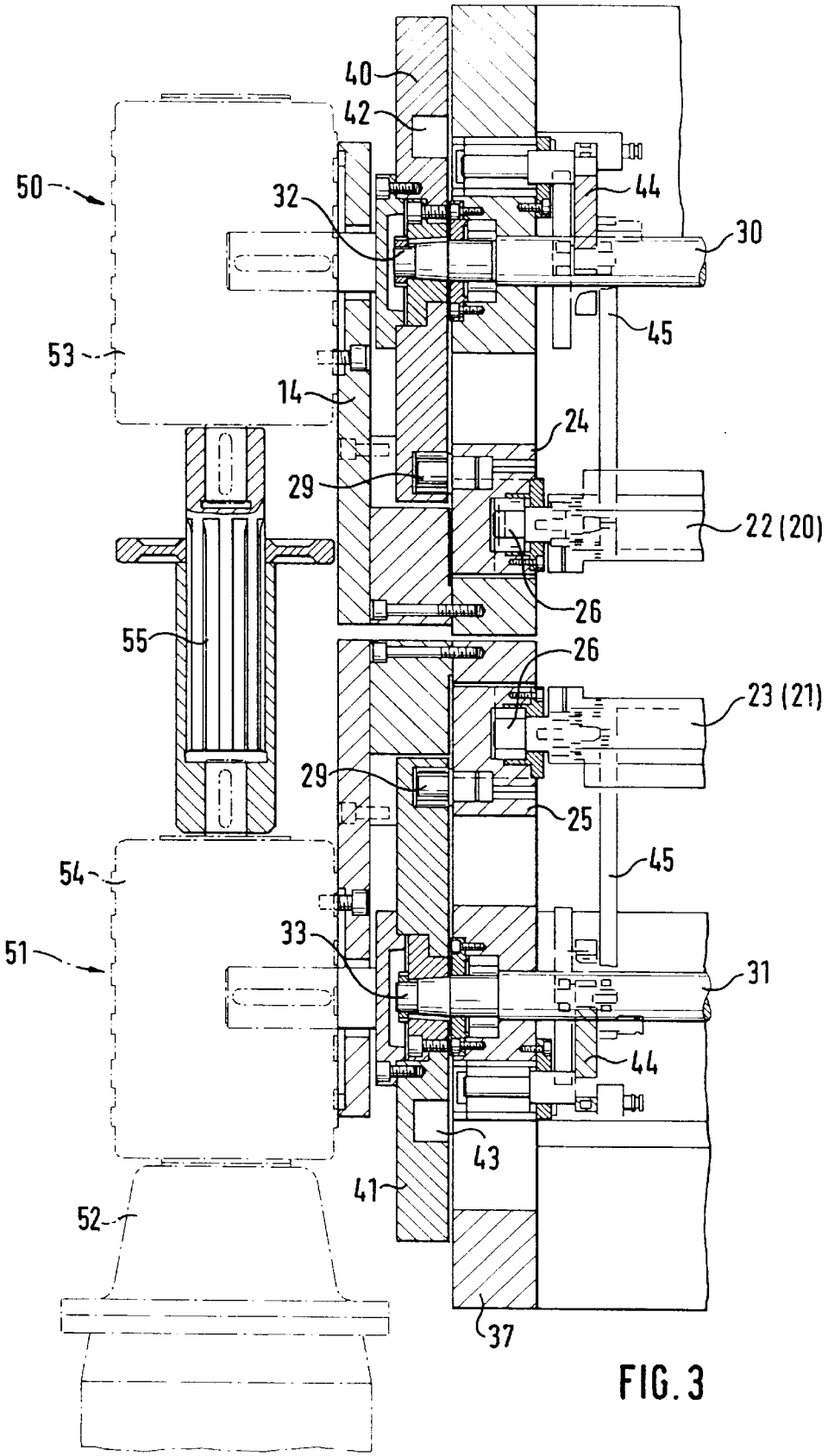
FIG. 3 is a part-sectional view corresponding to the lefthand portion of FIG. 1.
Figure 4:
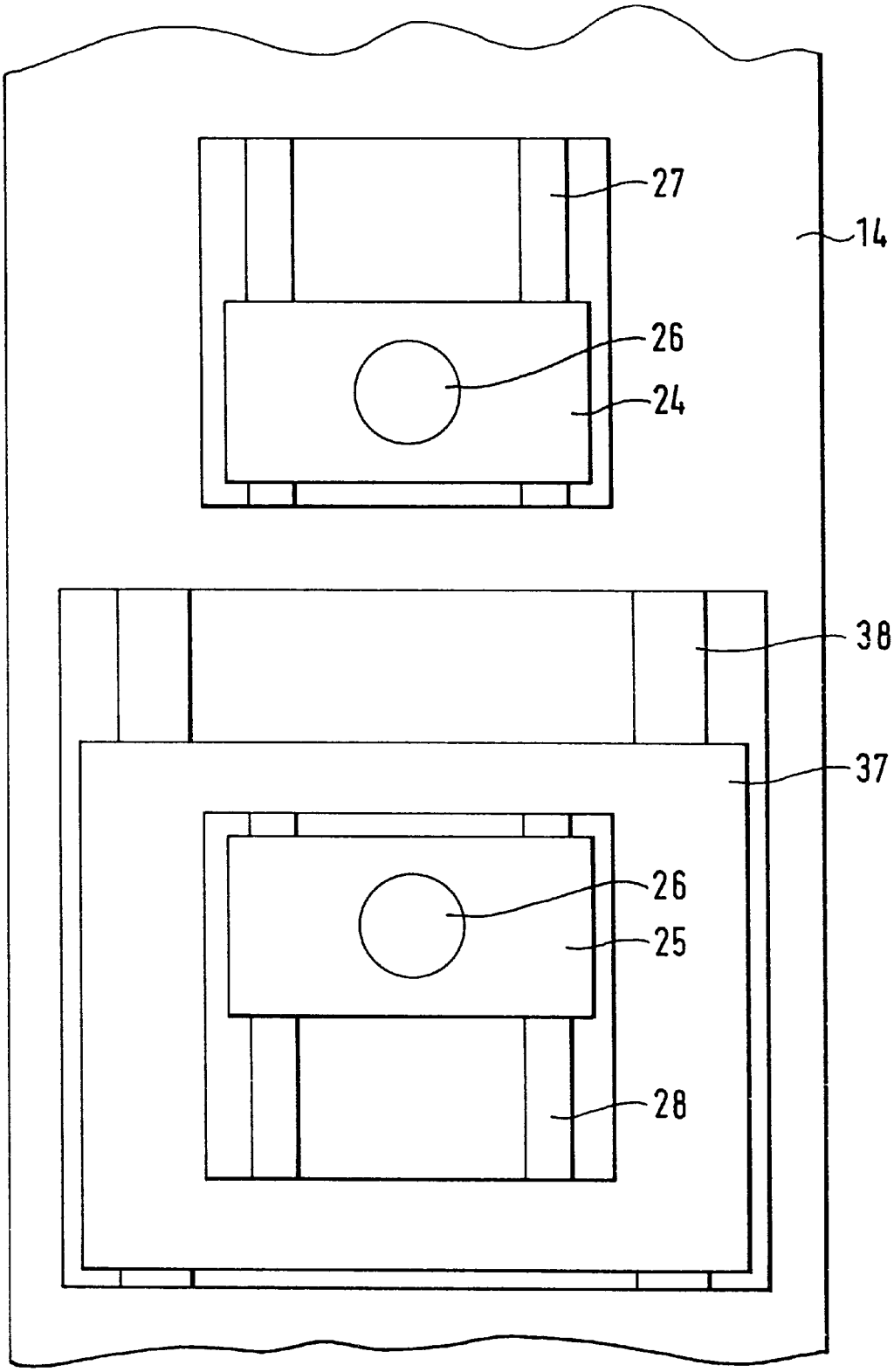
FIG. 4 is a diagrammatic side elevation of a height-adjustable shaft drive system.

Cam disks 40, 41, include cam grooves 42, 43 (FIG. 3) and are mounted at the ends of an upper main shaft 30 and of a lower main shaft 31 which are rotatably supported by bearings 32 and 33, respectively. The bearings 32 of upper shaft 30 are attached to side portions 14 of frame 11, whereas the bearings 33 of lower shaft 31 are fixed to linear carriages 37 of a vertical linear slideway 38 (FIG. 4).

Figure 9:
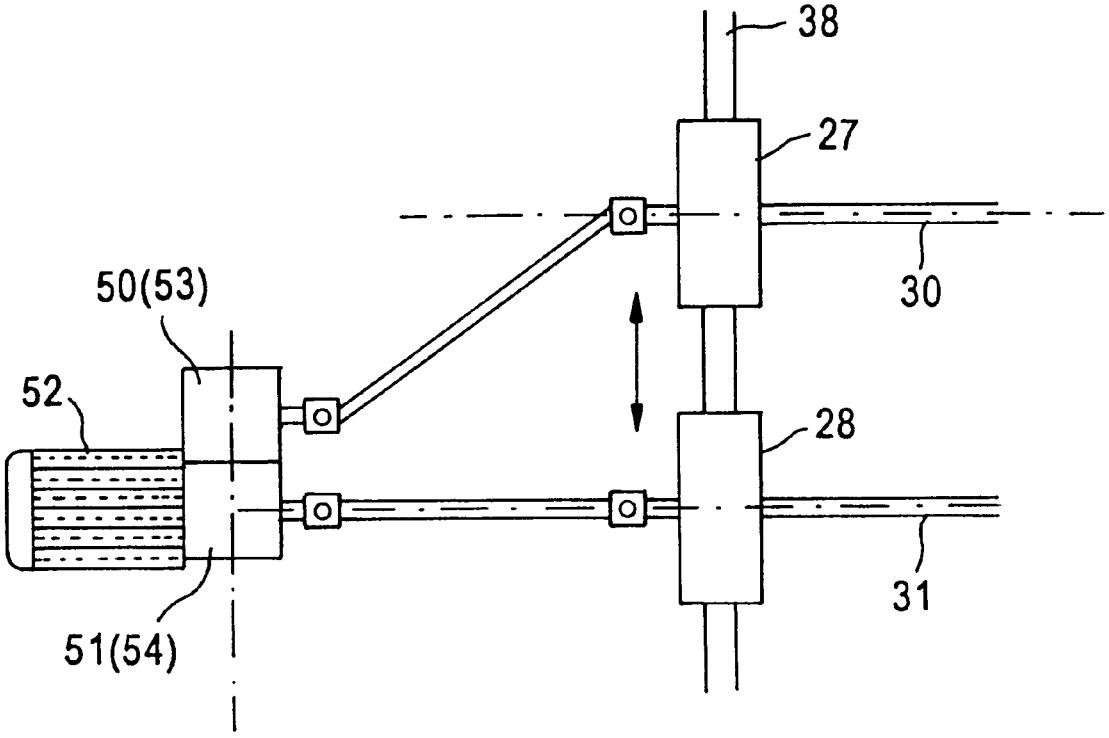
FIG. 9 illustrates a modification of the view of FIG. 3.

The main shafts 30, 31 are connected to T-type gears 53, 54 whose upper one, 53, is bolted to a side portion 14 while the lower gear 54 is bolted to the linear carriage 37. The two gears 53, 54 are preferably coupled via a toothed shaft 55 so that for driving them, only one electric motor 52 is required which may be attached, for instance, to the lower gear 54. An exactly synchronous rotation of shafts 30, 31 is thus warranted with little design expenditure and rather inexpensive simple means. Furthermore, the use of T-type gears 53, 54 and but one electric motor 52 provides for a space-saving structure. Alternatively, the gears 53, 54 may be coupled via toothed belts or via chains or via so-called Schmitz-type couplings; which serve to balance on offset between the centers of the shaft 30, 31. In an alternate embodiment shown in FIG. 9, the drive systems (50, 51) for the shafts (30, 31) may comprise cardan shafts. As shown therein, the associated gears (e.g., 53 and 54) may be driven by the motor (52).

Folding knives 20, 21 are screwed onto bars of knife beams 22, 23, respectively, and are supported by bearings 26 between two upper linear carriages 24 and two lower linear carriages 25, respectively. The upper linear carriages 24 move along vertical slideways 27 arranged in the side portions 14 whereas the lower linear carriages 25 are borne by vertical slideways 28 which are, together with the lower main shaft 31, arranged in a linear carriage 37 (FIG. 4). Linear carriages 24, 25 include sliding toes 29 that engage the cam grooves 42, 43 of cam disks 40, 41 for converting the rotation of shafts 30, 31 and of cam disks 40, 41 into a uniform vertical motion of folding knives 20, 21 along the slideways 27, 28. Therefore, the circular up-and-down motion of cam grooves 42, 43 is thus transferred to the linear carriages 24, 25 so that the folding knives 20, 21 move in mutually opposing vertical directions.

By shifting the linear carriage 37 along the linear slideways 38, e.g. via a lifting spindle drive 56 (FIG. 5), it is possible to change the distance between the main shafts 30, 31 and to thus adjust the folding height H (FIG. 2) of the knives 20, 21. As the drive system 51 of lower main shaft 31 is likewise attached to the linear carriage 37, the folding height adjustment can be performed in operation, too. The toothed shaft 55 arranged between the gears 53, 54 serves for power transmission and for path balancing. The folding height H is determined by a length meter (not shown) detecting the actual distance between the main shafts 30, 31 which is indicated by the control/display unit 90.

Figure 6:
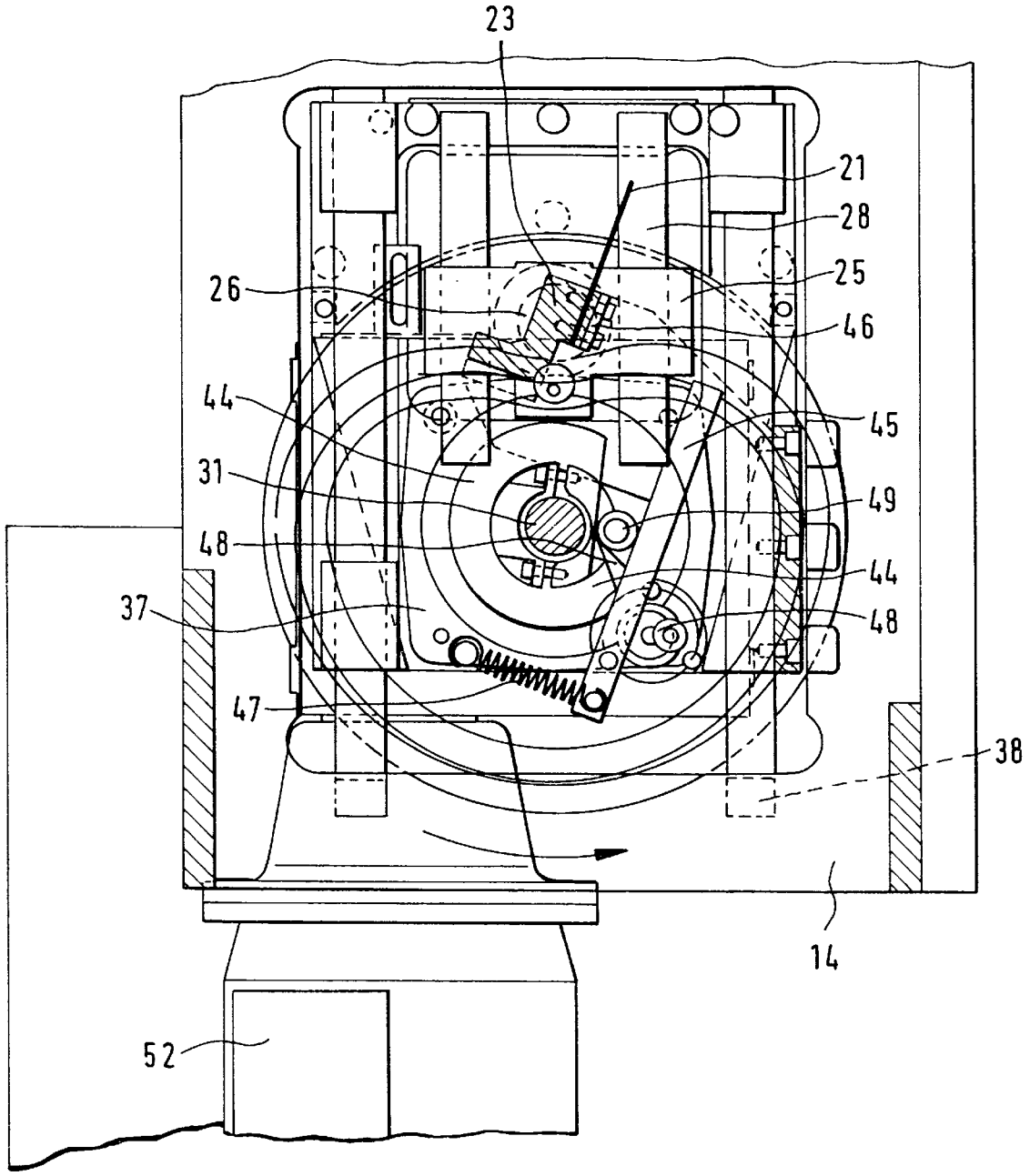
FIG. 6 is a diagrammatic side elevation, partly in section, of a knife guide system including rocker levers.

As shown in FIG. 6, the knife beams 22, 23 include additional rocker levers 45 serving to increase the pressure on the folding knives 20, 21 and to prevent a deflection of the knife beams 22, 23. To the ends and centers of the latter, the rocker levers 45 are screwed whose free ends are engaged by tension springs 47. These are, along with a pivotable lever arm 48, attached e.g. via bearing chairs 18 to the side portions 14, to the linear carriage 37 and to the centers of the folding knives 20, 21, respectively. The pivotable lever arms 48 have roller or ball bearings 49 at their free ends. By the springs 47, the rocker levers 45 are pulled towards the roller or ball bearings 49 so that the lever arms 48 engage the eccentric disks 44. As the shafts 30, 31 rotate, the rollers 49 follow the contours of the eccentric disks 44 and transfer this motion onto the rocker levers 45. In this way, the knife beams 22, 23 are additionally load-biased synchronously to the up-and-down movement of the folding knives whereby a bow or deflection of the beams 22, 23 is effectively avoided even during the folding operation.

Figure 7:
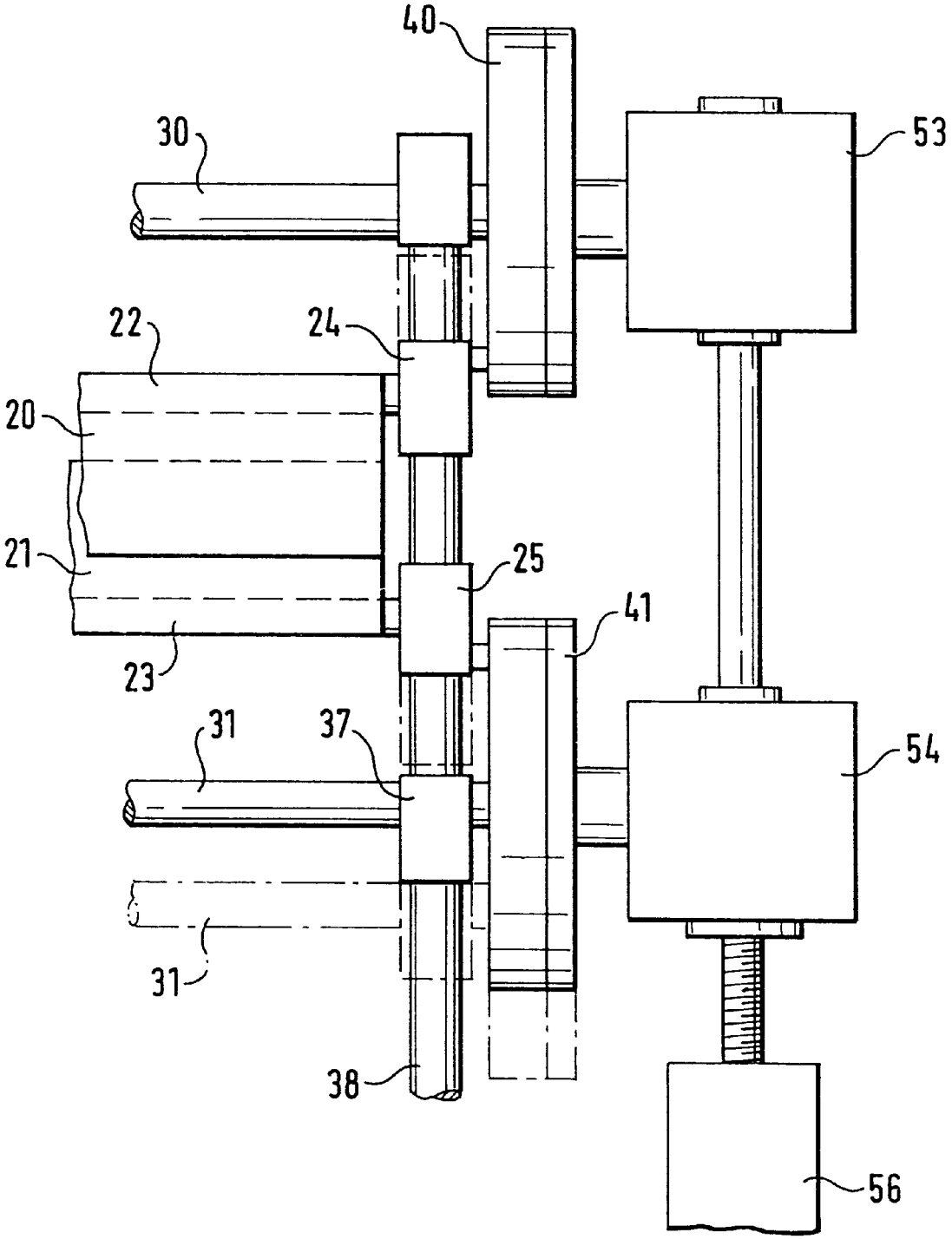
FIG. 7 is a diagrammatic side elevation of another embodiment of a height-adjustable shaft drive system.
Figure 8A:
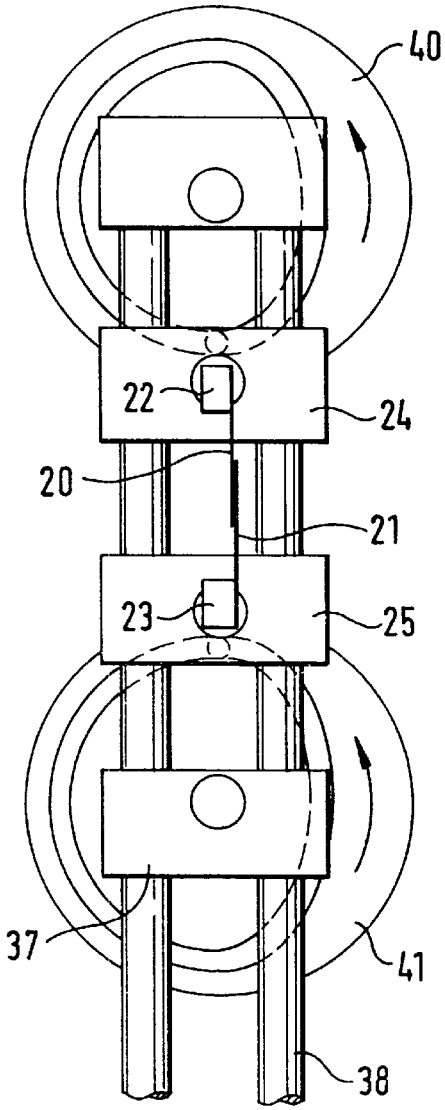
FIG. 8*a* is a front view of a system as per FIG. 7 with large folding height.
Figure 8B:
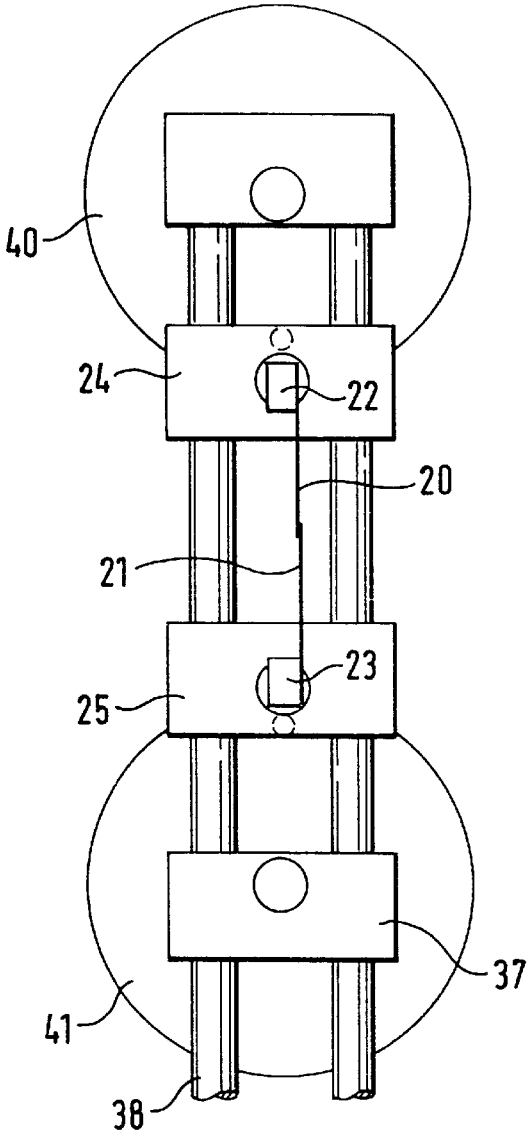
FIG. 8*b* is a front view of a system as per FIG. 7 with small folding height.

By another embodiment shown in FIG. 7, the linear carriages 24, 25 of the folding knives 20, 21 are guided on a common linear slideway 38, as are the linear carriages 37 of the main shafts 30, 31 (see also FIGS. 8*a*, 8*b*).

The gear 54 fixed to the linear carriage 37 of the lower main shaft 31 is connected to the lifting spindle drive 56 that runs the linear carriage 37 along the slideway 38. It will be seen that the folding height H can thus be adjusted automatically.

Run-in table 60 is height-adjustable depending on the position set for the folding knives 20, 21 whereby the web or material M to be folded will always be fed centrally relative to the folding height H. The evened-out web feeding is assisted in that the run-in table 60 as well as the linear carriages 24, 25, 37 are guided in a vertical post or column jig (not shown) and are moved by a lever mechanism 61 coupled to the linear carriage 37. The lever transmission ratio is preferably 2:1 so that the run-in table 60 will be shifted—up or down, as the case may be—by half the folding height H, e.g. by 25 mm for H=50 mm.

Fork joints (not shown) on either side are extremely useful for horizontally moving the table 60. Regulation of the tension in the run-in material M can easily be effected by a bend or loop of slight S-shaped fed over a roller set consisting of a jockey pair 62 between which there is a support roller 63 (FIG. 2). In a manner known per se, the jockey pretensioning can be sensitively adjusted via springs (not shown). Under acceleration, tension forces will tend to elevate the jockeys 62 vis-a-vis the support roller 63.

An upper limit for the format of the fold is provided by an upper table 65 acting as a shaping plate that is loaded by at least two pneumatic pressure cylinders 66 and is adapted to be shifted within a jig post (not shown), depending on the actual folding height H. The motion of the linear carriages 37 and, consequently, of the lever mechanism 61 is transmitted, in a simple and convenient way, to the upper table 65 if the latter is, for example, engaged by spindles 67 mounted thereto. If desired the parallelism of upper table 65 can be vernier-adjusted under observation at the display unit 90 of the height set on either side.

Counter-pressure line 80 comprises at least four pneumatic pressure cylinders 82 for loading two sliding blocks 84 and thus the material M running out. As with the pressure cylinders 66 of the upper table 65, pressure reducers (not shown) may be used for sensitively controlling the acting pressure.

Independently controlled heating systems (not shown) are accommodated in and above the run-in table 60, the run-out table 70 and the shaper plate or upper table 65. The range of temperature control is preferably from 20° C. to 200° C. Good thermal contact between sensors and heating plates (not shown either) is obtained through thermo-oil filled tapped holes. In order to attain uniform warm-up of the tables and plates 60, 65, 70, respectively, the heating systems may be set going prior to the beginning of manufacture, e.g. using a timer. A light barrier (not shown) may be employed to check if there is material M within the folding device 10 so that high operational reliability is warranted.

Figure 5:
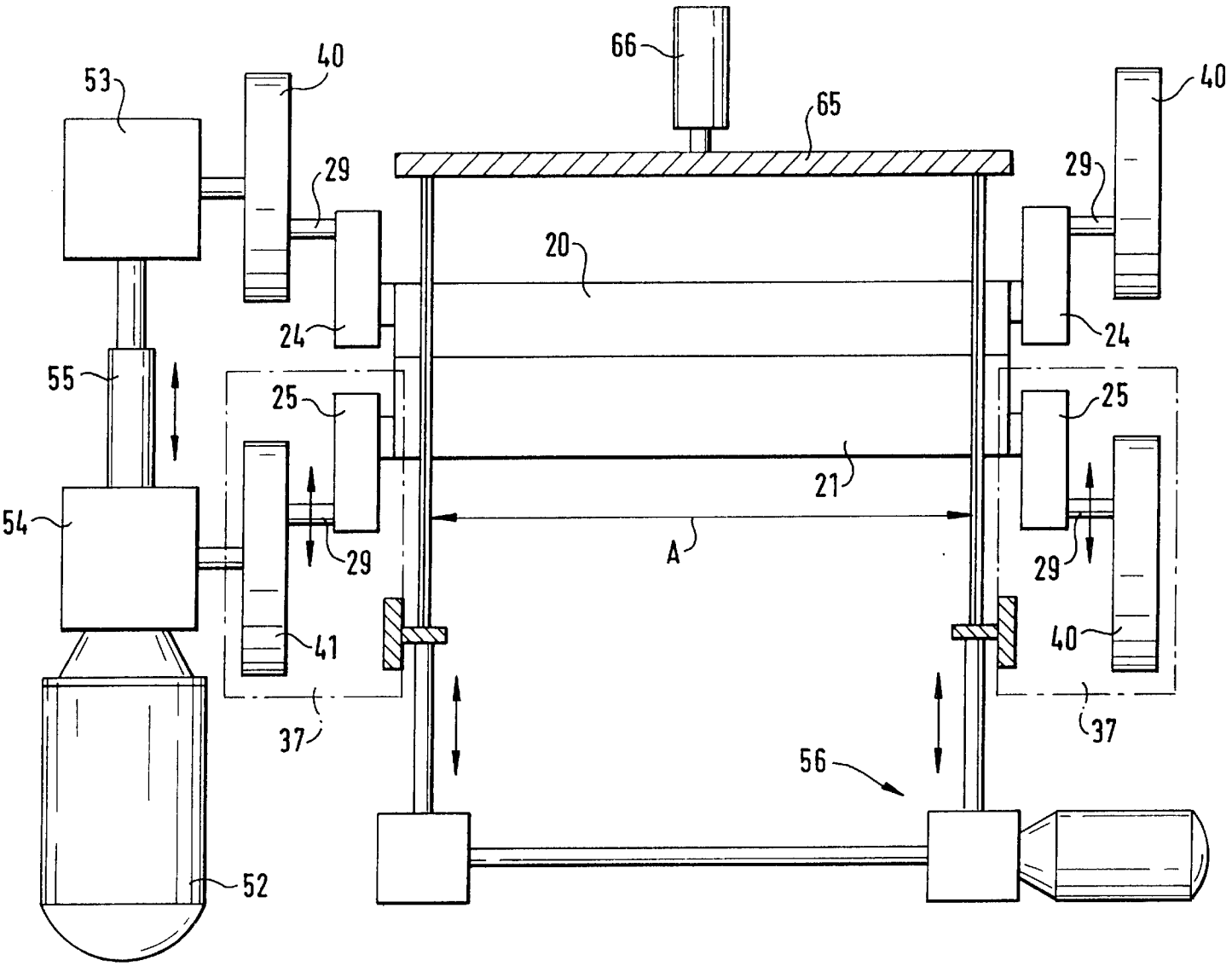
FIG. 5 is a schematic front view of a lifting spindle system.

The actual folding height H is continuously monitored by means of a measuring unit 86 (FIG. 2) arranged behind the sliding blocks 84 and adapted for movement across the entire working width A (FIG. 5). Any deviations from the desired folding height will thus immediately be recognized; correction is possible in operation by carefully readjusting the linear carriages 37 via the lifting spindle drive 56. The number of folds performed is counted via an inductive sensor (not shown) at the main shafts 30, 31; an enumerator or counter serves for totalizing, while a further enumerator (not shown either) counts the quantity of articles manufactured per unit of time. All the data measured will be indicated on the display unit 90.

The invention is not restricted to the embodiments described but open to numerous variations. Thus both main shafts 30, 31 as well as their drive systems 50, 51 can be supported by linear carriages 37 to the effect that the folding height H is adjustable by shifting both shafts 30, 31 under comfortable control via measuring system and limit switches (not shown). It is possible to equip the run-in and run-out components with dual web or multiple web guides. If desired, in particular for marking purposes, a spray device may easily be arranged e.g. in the run-in zone; by means of a suitable timer, the length of a marking can be accurately set.

Important advantages of the invention reside in that the folding device 10, preferably for automatically manufacturing multiple-layer bellows, permits especially continuous adjustment of the folding height H, e.g. in ranges between 5 mm to 50 mm and 5 mm to 100 mm; this is performed within a short spell of, say, less than 5 min. Depending on the type of material M, a production capacity of 150 folds/min is well in reach for working widths A up to 1,000 mm. The additional rocker levers 45 contribute materially to subduing any deflections of the main shafts 30, 31.

Among the many modifications to which the invention lends itself is the use of various drive means such as hydraulic or pneumatic actuators or mechanisms of suitable design. Basically, however, the folding device 10 includes two cam-controlled folding knives 20, 21 that are vertically moveable relative to each other; a run-in table 60 vertically shiftable synchronously with the folding knives; and a counter-pressure line 80 having at least one pressure cylinder 82 per sliding block 84. The shafts 30, 31 and their drive systems 50, 51 are shiftable in mutually opposed vertical directions and are synchronized, e.g. electronically or via T-type gears 53, 54 having a common motor 52. At least one shaft 31 with its motor 51 is shiftable in a linear carriage 37 of a vertical linear slideway 38. The folding knives 20, 21 are rotatably supported at linear carriages 24, 25 guided on linear slideways 27, 28 and connected to cam disks 40, 41 which, synchronously with at least two eccentric disks 44 fixed to the shafts 30,31, bear on associated rocker levers 45. A measuring system 86 behind the sliding blocks 84 is adapted for travelling across the entire working with A. A control/display unit 90 continuously shows the height shifting of the folding knives 20, 21, of the run-in table 60 and of an upper shaping plate or upper table 65.

All and any features and advantages—including design details, spatial arangements and procedural steps—arising from the claims, the description and the drawings may be inventively important both per se and in most variegated combinations.

Legend
A working width
H folding height
M material (web)

| | | | |
|---|---|---|---|
| 10 | folding machine | 48 | lever arm |
| 11 | frame | 49 | roller/ball bearing |
| 14 | side portion | 50, 51 | drive (system) |
| 18 | bearing chair | 52 | motor |
| 20, 21 | folding knives | 53, 54 | T-type gear |
| 22, 23 | knife beam drive | 55 | toothed shaft |
| 24, 25 | linear carriage | 56 | lifting spindle drive |
| 26 | bearing | 60 | run-in table |
| 27, 28 | linear slideway | 61 | lever mechanism |
| 29 | sliding toe | 62 | jockey pair |
| 30, 31 | shaft | 63 | support roller |
| 32, 33 | bearing | 65 | upper table |
| 37 | linear carriage | 66 | pressure cylinder |
| 38 | linear slideway | 67 | spindle |
| 40, 41 | cam disk | 70 | run-out table |
| 42, 43 | cam grooves | 80 | counter-pressure line |
| 44 | eccentric disk | 82 | pressure cylinder |
| 45 | rocker lever | 84 | sliding block |
| 46 | end | 86 | measuring system |
| 47 | tension spring | 90 | control/display unit |

I claim:

1. Folding device (10) including two motor-driven folding knives (20,21) which are vertically movable relative to each other by means of cam disks (40, 41) supported on shafts (30, 31) having associated respective drive systems (50, 51), including a run-in table (60) for material (M) to be folded and including a counter-pressure line (80), wherein the shafts (30, 31) are coupled for synchronized movement and, together with their drive system (50, 51), are adapted for shifting in synchronism in mutually opposing vertical directions, further comprising a drive (56) for shifting the shafts (30, 31) by moving at least one of said shafts together with the respective drive system thereof to change a pleat height of folds of the material to be folded.

2. A folding device according to claim 1, wherein said folding knives include an upper knife (20) vertically movable by an upper cam disk (40) supported on an upper rotational shaft (30) having an associated upper drive system (50) and a lower knife (21) vertically movable by a lower cam disk (41) supported on a lower rotational shaft (31) having an associated lower drive system (51), wherein said drive (56) is connected for moving at least said lower cam disk (41), said lower rotational shaft (31) and said lower drive system (51) for adjusting the pleat height of the folds.

3. A folding device according to claim 2, wherein said respective drive systems (50, 51) comprise motors and wherein said drive adjusts the pleat height of the folds by moving at least said motor of said lower drive system (51).

4. A knife pleating system (10) including two motor-driven folding knives (20,21) which are vertically movable relative to each other by means of cam disks (40, 41) supported on shafts (30, 31) having associated respective drive systems (50, 51), including a run-in table (60) for material (M) to be folded and including a counter-pressure line (80), wherein the shafts (30, 31) are coupled for synchronized movement and, together with their drive system (50, 51), are adapted for shifting in synchronism in mutually opposing vertical directions, further comprising a variable speed drive (56) for adjusting a folding height for the material by shifting the shafts (30, 31) in mutually opposing directions and by moving at least one of said shafts together with the respective drive system thereof to change a pleat height of folds of the material to be folded, wherein the variable speed drive (56) comprises a lifting spindle unit.

5. Device according to claim 4, wherein the drive systems (50, 51) comprise electronically coupled motors.

6. Device according to claim 4, wherein the drive systems (50, 51) for the shafts (30, 31) comprise T-type gears (53, 54) having a common motor (52).

7. Device according to claim 6, wherein the gears (53, 54) for the shafts (30, 31) are coupled via a toothed shaft (55) or via a keyway.

8. Device according to claim 6, wherein the gears (53, 54) of the shafts (30, 31) are linked via an offset balance coupling system.

9. Device according to claim 6, wherein the gears (53, 54) of the shafts (30, 31) are linked via toothed belts or via chains with gear units.

10. Device according to claim 6, wherein the T-type gears (53, 54) for the shafts (30, 31) are coupled via a keyway.

11. Device according to claim 4, wherein the drive systems (50, 51) for the shafts (30, 31) comprise a shaft with associated gears driven by at least one motor.

12. Device according to claim 4, wherein at least one shaft (31) and its drive (51) is supported in a linear carriage (37) of a vertical linear slideway (38).

13. Device according to claim 12, wherein the linear slideway (38) includes a slide track.

14. Device according to claim 12, wherein the run-in table (60) and an upper shaping plate or an upper table (65) are vertically height-adjustable in synchronization with the folding knives (20,21) by means of an adjustable lifting spindle system.

15. Device according to claim 12, wherein the run-in table (60) and an upper shaping plate or an upper table (65) are vertically height-adjustable in synchronization with the folding knives (20,21) by means of an adjustable lever mechanism.

16. Device according to claim 4, wherein at least two cam disks (40, 41) are associated to each of the folding knives (20, 21).

17. Device according to claim 4, wherein the run-in table (60) and an upper shaping plate are vertically height-adjustable in synchronization with the folding knives (20, 21).

18. Device according to claim 4, wherein the counter-pressure line (80) includes at least one pressure cylinder (82) per sliding block (84).

19. Device according to claim 18, wherein a measuring system (86) is arranged behind the sliding block (84( for travelling across the total working width (A).

20. Device according to claim 4, wherein the run-in table (60) and an upper table (65) are vertically height-adjustable in synchronization with the folding knives (20, 21).

21. Device according to claim 4, wherein the counter-pressure line (80) includes at least one pressure cylinder (82) per contact pressure plate.

22. Device according to claim 4, wherein the drive systems (50, 51) for the shafts (30, 31) comprise cardan shafts with associated gears driven by at least one motor.

23. Folding device (10) including two motor-driven folding knives (20,21) which are vertically movable relative to each other by means of cam disks (40, 41) supported on shafts (30, 31) having associated drive systems (50, 51), including a run-in table (60) for material (M) to be folded and including a counter-pressure line (80), wherein the shafts (30, 31) are coupled for synchronized movement and, together with their drive system (50, 51), are adapted for shifting in synchronism in mutually opposing vertical directions, wherein at least one shaft (31) and its drive (51) is supported in a linear carriage (37) of a vertical linear slideway (38), and means for shifting the shafts (30, 31) by moving said linear carriage (37) including said at least one shaft (31) together with the respective drive (51) thereof to change a pleat height of folds of the material to be folded.

24. Device according to claim 23, wherein the run-in table (60) is height-adjustable centrally relative to the folding height (H) depending on the position set for the folding knives (20, 21).

25. A knife pleating system (10) including two motor-driven folding knives (20,21) which are vertically movable relative to each other by means of cam disks (40, 41) supported on shafts (30, 31) having associated drive systems (50, 51) including a run-in table (60) for material (M) to be folded and including a counter-pressure line (80), wherein the shafts (30, 31) are coupled for synchronized movement and, together with their drive system (50, 51), are adapted for shifting in synchronism in mutually opposing vertical directions, further comprising a variable speed drive (56) for shifting the shafts (30, 31) with their drive systems (50, 51) in mutually opposing directions, wherein the variable speed drive (56) comprises a lifting spindle unit, wherein the run-in table (60) and an upper shaping plate are vertically height-adjustable in synchronization with the folding knives (20, 21), and further comprising display units (90) for continuously indicating the height positions of the folding knives (20, 21), of the run-in table (60) and of the upper shaping plate.

26. A knife pleating system (10) including two motor-driven folding knives (20,21) which are vertically movable relative to each other by means of cam disks (40, 41)

supported on shafts (30, 31) having associated drive systems (50, 51), including a run-in table (60) for material (M) to be folded and including a counter-pressure line (80), wherein the shafts (30, 31) are coupled for synchronized movement and, together with their drive system (50, 51), are adapted for shifting in synchronism in mutually opposing vertical directions, further comprising a variable speed drive (56) for shifting the shafts (30, 31) with their drive systems (50, 51) in mutually opposing directions, wherein the variable speed drive (56) comprises a lifting spindle unit, wherein the run-in table (60) and an upper table (65) are vertically height-adjustable in synchronization with the folding knives (20, 21), and further comprising display units (90) for continuously indicating the height positions of the folding knives (20, 21), of the run-in table (60) and of the upper table (65).

27. A folding device (10) including two motor-driven folding knives (20, 21) which are vertically movable relative to each other under control of cam disks (40, 41) supported on rotatable shafts (30, 31) having associated drive systems (50, 51), including feeding means for flat material (M) to be folded as well as a counter-pressure line (80) and a height-adjustable run-in table (60) for feeding the material (M) to be folded at a center level of the folding knives (20, 21), wherein a drive system of a lower folding knife (21) is adapted to be lifted and lowered, respectively, for adjusting a folding height (H) of the material (M).

28. A folding device according to claim 27, wherein the folding height (H) is adjustable during operation by changing the distance between the shafts (30, 31) as a supporting linear carriage (37) is shifted along a linear slideway (38).

29. A folding device according to claim 28, wherein the run-in table (60) is vertically shiftable synchronously with the folding knives (20, 21) and wherein knife beams (22, 23) are supported by linear carriages (24, 25) which in turn are supported in vertical slideways (27, 28).

30. A folding device according to claim 29, wherein at least one shaft (31) with its motor (51) is shiftable in the linear carriage (37) of the linear slideway (38) which is arranged vertically and wherein means are provided for transferring a circular up-and-down motion of toes (29) sliding in grooves (42, 43) of cam disks (40, 41) to the linear carriages (24, 25), whereby the cam-controlled folding knives (20, 21) move in mutually opposing vertical directions.

31. A folding device according to claim 28, wherein at least one shaft (31) with its motor (51) is shiftable in the linear carriage (37) of the linear slideway (38) which is arranged vertically and wherein means are provided for transferring a circular up-and-down motion of toes (29) sliding in grooves (42, 43) of cam disks (40, 41) to the linear carriages (24, 25), whereby the cam-controlled folding knives (20, 21) move in mutually opposing vertical directions.

32. A folding device according to claim 27, wherein the run-in table (60) is vertically shiftable synchronously with the folding knives (20, 21) and wherein knife beams (22, 23) are supported by linear carriages (24, 25) which in turn are supported in vertical slideways (27, 28).

33. A folding device according to claim 27, wherein the knife beams (22, 23) include spring-loaded rocker levers (45) engaging eccentric disks (44) for increased pressure onto the folding knives (20, 21).

* * * * *